US006269550B1

(12) United States Patent
Martin

(10) Patent No.: US 6,269,550 B1
(45) Date of Patent: Aug. 7, 2001

(54) DRYING MACHINE FOR SHREDDED TOBACCO, IN PARTICULAR FOR ROLLS OF EXPANDED SHREDDED TOBACCO

(75) Inventor: Mario Martin, Treviso (IT)

(73) Assignee: Comas S.p.A., Treviso (IT)

( * ) Notice: Subject to any disclaimer, the term of this patent is extended or adjusted under 35 U.S.C. 154(b) by 0 days.

(21) Appl. No.: 09/367,356

(22) PCT Filed: Feb. 5, 1998

(86) PCT No.: PCT/EP98/00630

§ 371 Date: Aug. 12, 1999

§ 102(e) Date: Aug. 12, 1999

(87) PCT Pub. No.: WO98/35569

PCT Pub. Date: Aug. 20, 1998

(30) Foreign Application Priority Data

Feb. 12, 1997 (IT) ..... TO97A0110

(51) Int. Cl.[7] ..... F26B 11/00
(52) U.S. Cl. ..... 34/185; 34/187
(58) Field of Search ..... 34/86, 164, 178, 34/185, 187, 188, 196, 207, 208

(56) References Cited

U.S. PATENT DOCUMENTS

| | | | | |
|---|---|---|---|---|
| 2,713,213 | | 7/1955 | Bogaty . | |
| 3,060,590 | * | 10/1962 | Brown | 34/20 |
| 3,229,377 | * | 1/1966 | Hoyt | 34/10 |
| 4,109,394 | | 8/1978 | Hoyt . | |
| 4,201,499 | * | 5/1980 | Buske et al. | 406/75 |
| 4,306,359 | | 12/1981 | Hoyt . | |
| 4,322,447 | | 3/1982 | Hubbard . | |

FOREIGN PATENT DOCUMENTS

| | | |
|---|---|---|
| 0226673A | 7/1987 | (EP) . |
| 2236428A | 2/1975 | (FR) . |
| 2026668A | 2/1980 | (GB) . |
| 2085564A | 4/1982 | (GB) . |
| WO 7900800A | 10/1979 | (WO) . |

* cited by examiner

*Primary Examiner*—Stephen Gravini
*Assistant Examiner*—Michelle A Mattera

(57) ABSTRACT

The machine (1) includes a tunnel structure (2) which defines a chamber (8) with inclined, downwardly converging longitudinal side walls (9) and in which a substantially horizontal conveyor (10) for conveying a layered flow of shredded tobacco (T) from the input end (6) to the output end (7) of the chamber (8) extends adjacent the lower edges (9*b*) of the converging side walls (9). A ventilation system (16–25) is provided in this latter, having a delivery manifold (16) which extends above the conveyor (10), an array of vertical tubes (17) which extend from the delivery manifold (16) to a predetermined distance from the conveyor (10) between the lower edges (9*a*) of the converging side walls (9), a return manifold (18) communicating with lateral regions of the chamber (8) situated to the sides of the array of tubes (17) and above the converging side walls (9), and air conditioning and recycling apparatus (20–25) interposed between the outlet (23) of the return manifold (18) and the delivery manifold (16) for inducing flow of conditioned air through the tubes (17) towards the conveyor (10) in such a way that the air leaving the tubes (17) creates a bed of air above the conveyor (10) for fluidizing the layered flow of tobacco (T).

10 Claims, 6 Drawing Sheets

DRYING MACHINE FOR SHREDDED TOBACCO, IN PARTICULAR FOR ROLLS OF EXPANDED SHREDDED TOBACCO

The present invention concerns a drying machine for shredded tobacco, in particular (but not exclusively) for rolls of expanded shredded tobacco.

The drying machine according to the invention is characterised in that it includes:

a tunnel structure with an input end and an output end in which a chamber is defined with inclined longitudinal downwardly converging side walls;

a substantially horizontal conveyor which extends within the tunnel structure adjacent the lower edges of the converging side walls, for transferring a layered flow of shredded tobacco from the inlet to the outlet; and a ventilation system including:

a delivery manifold which extends over the conveyor;

an array of essentially vertical tubes which extends from the delivery manifold to a predetermined distance from the conveyor, between the lower edges of the converging side walls;

a return manifold communicating with lateral regions of the chamber situated at the sides of the array of tubes and above the converging side walls; and air conditioning and recycling means interposed between the outlet of the return manifold and the inlet of the delivery manifold and adapted to supply a flow of conditioned air through the tubes towards the conveyor in such a way that, in use, the air leaving the tubes creates a bed of air above the conveyor for fluididizing the layered flow of tobacco, and the air emitted from the tubes is then returned to the return manifold through the lateral regions of the chamber in such a way that any particles of tobacco carried by the return air flow in the lateral regions of the chamber fall under gravity onto the converging side walls and down onto the conveyor.

Further characteristics and advantages of the invention will become clear from the following detailed description, given purely by way of non-limitative example, with reference to the accompanying drawings, in which.

Figure 1:
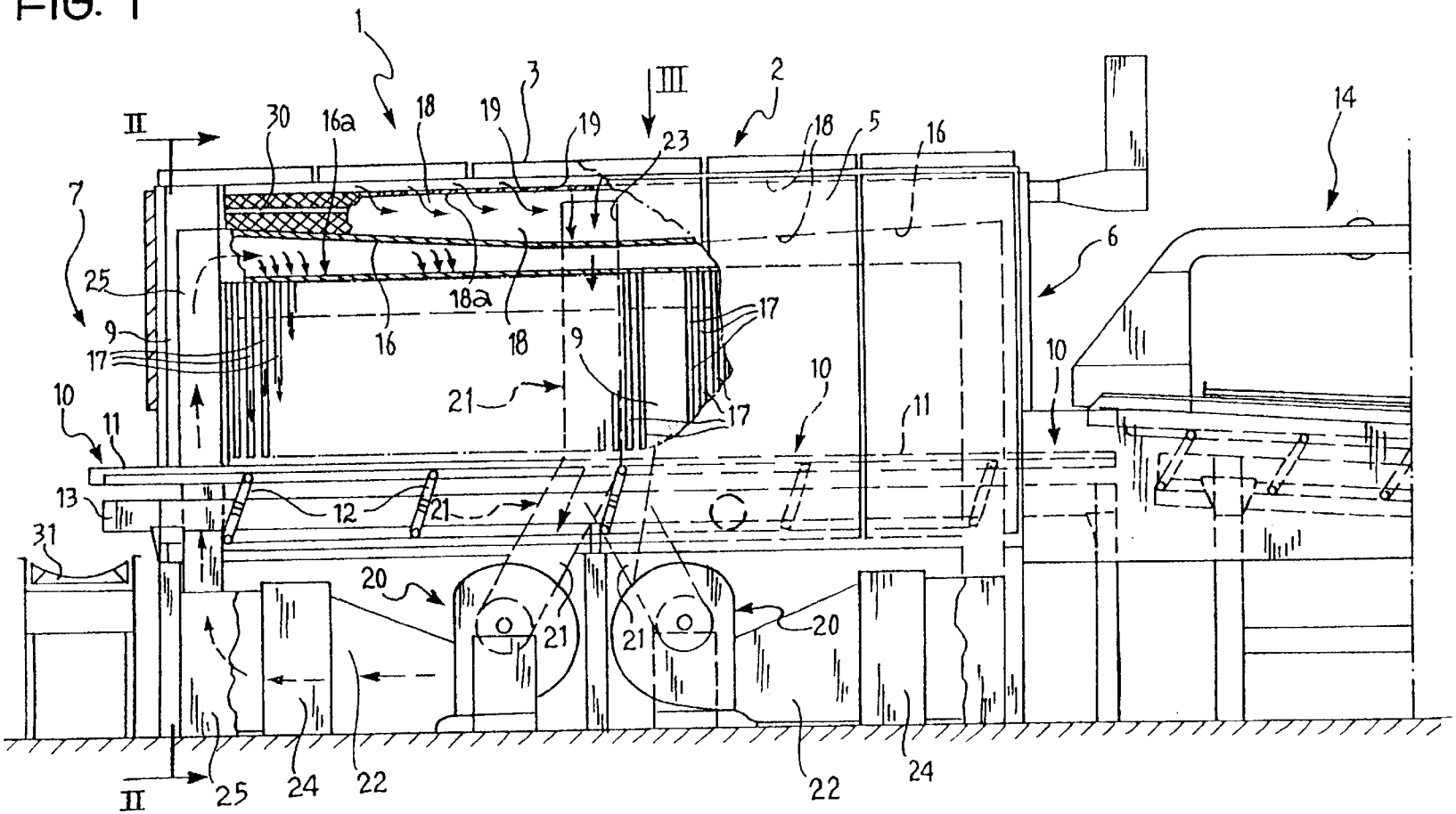
FIG. 1 is a partially-sectioned side view of a drying machine according to the invention.

In FIG. 1 the reference numeral 1 generally indicates a machine for drying shredded tobacco, in particular, rolls of expanded, shredded tobacco, according to the invention.

Figure 2:
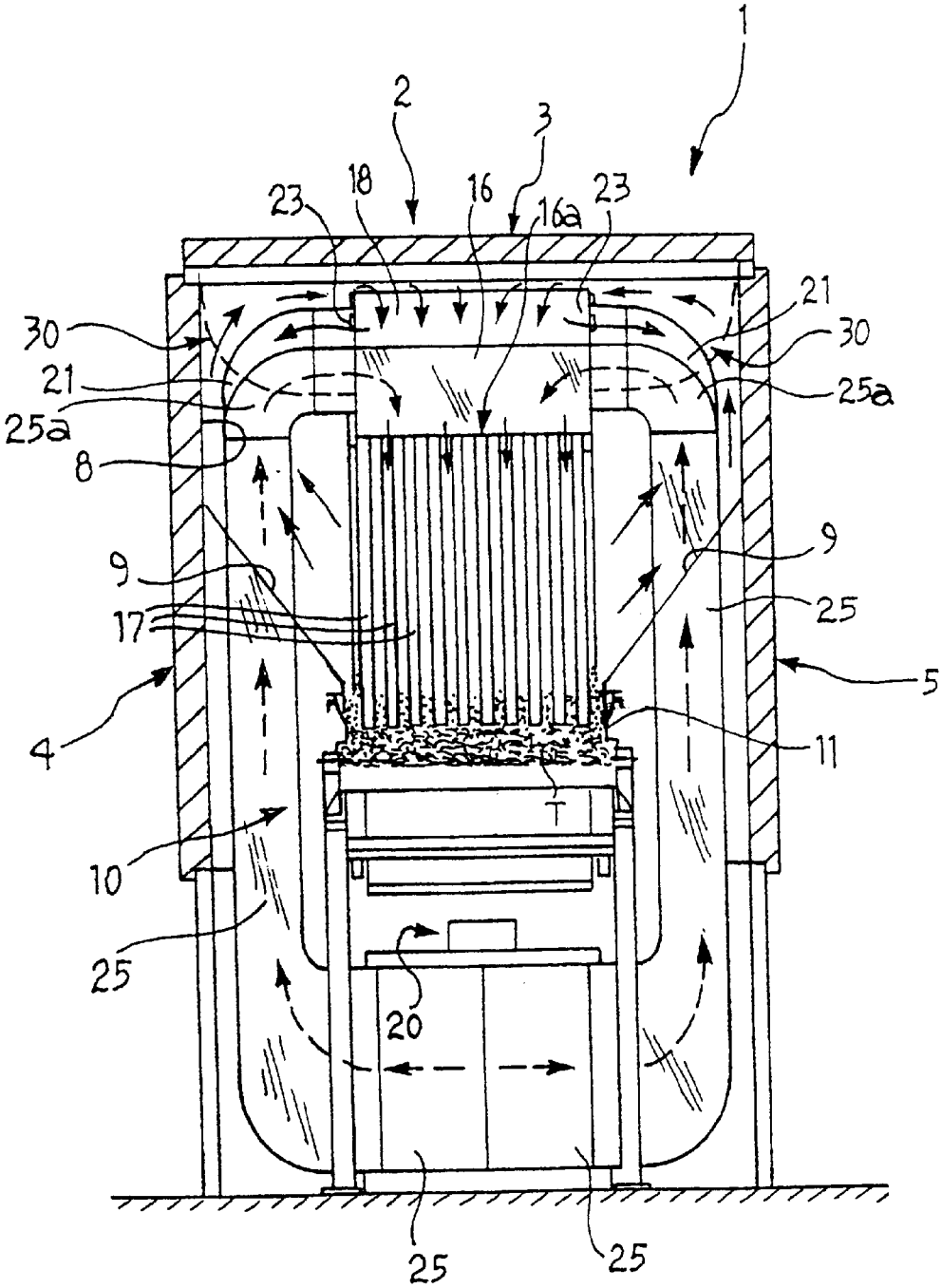
FIG. 2 is a sectional view taken on the line II—II of FIG. 1.
Figure 3:
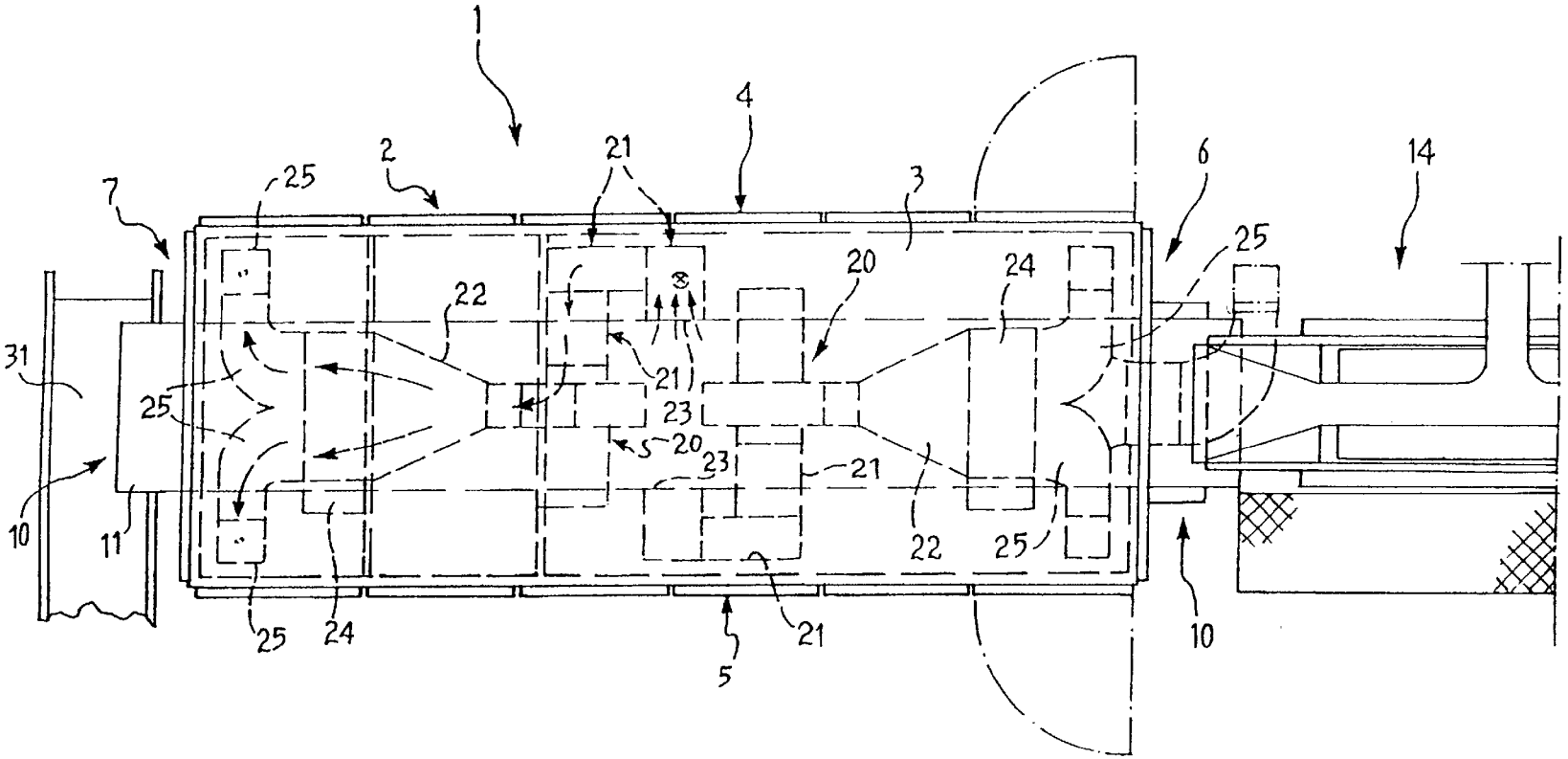
FIG. 3 is a plan view from above of the machine shown in FIGS. 1 and 2.

The machine 1 includes a tunnel structure 2, with an upper wall 3 and two longitudinal vertical side walls 4 and 5 (also seen in FIGS. 2 and 3).

The tunnel structure 2 has an input end 6 and an output end 7.

A chamber, generally indicated 8 (see FIG. 2 in particular), is defined within the tunnel structure 2. The top of the chamber 8 is defined by the wall 3 and its sides are bounded partly by the side walls 4 and 5 and partly by a pair of inclined longitudinal, downwardly-converging side walls 9.

The reference numeral 10 in FIGS. 1 and 2 generally indicates a substantially horizontal conveyor which extends into the tunnel structure 2 adjacent the lower edges of the aforesaid inclined converging side walls 9.

The conveyor 10 is, for example (but not necessarily) an oscillating conveyor, inclined slightly downward towards the outlet of the tunnel structure 2.

Figure 4:
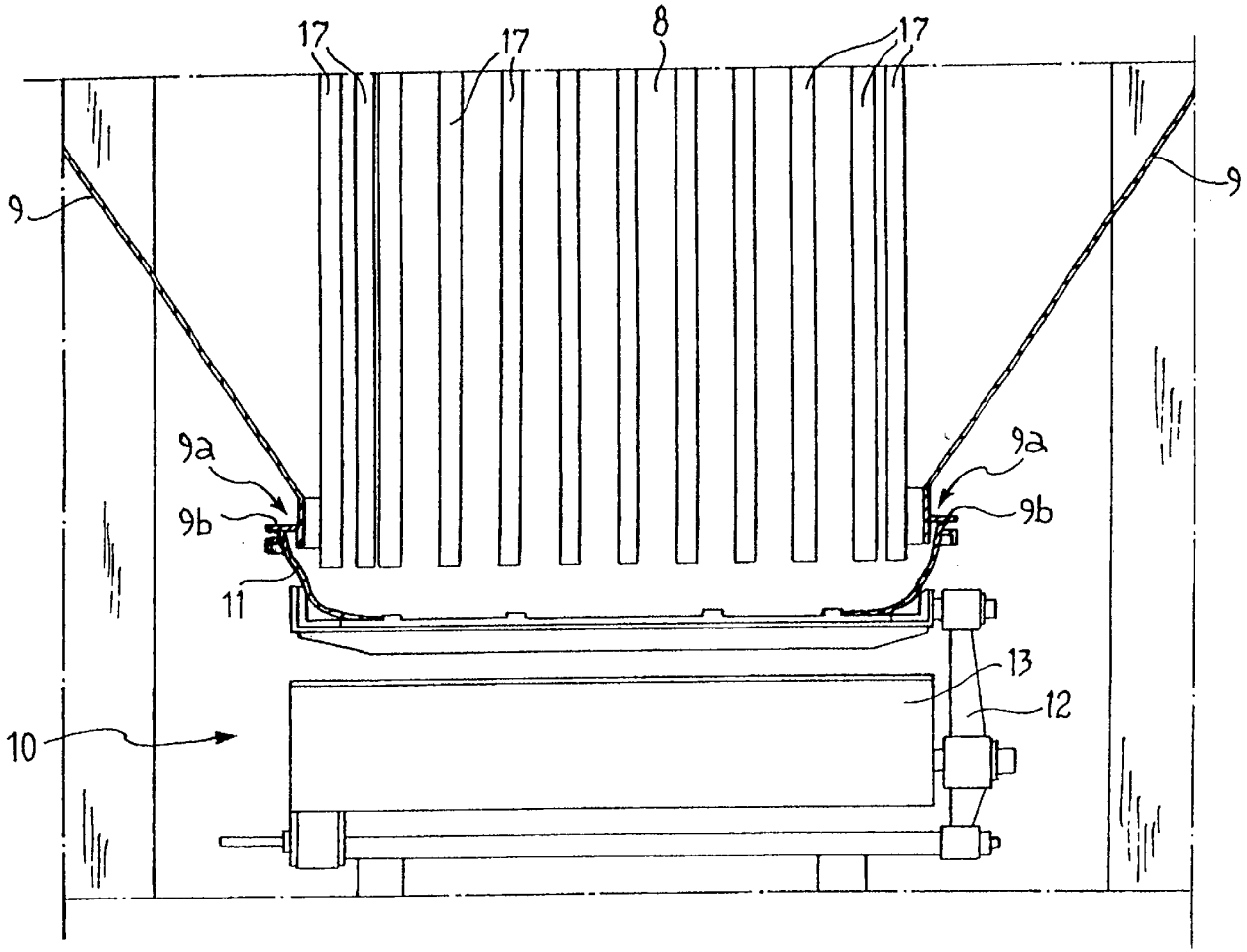
FIG. 4 is a view on an enlarged scale of a detail of the machine shown in FIG. 2.

In the embodiment illustrated in the drawings, the conveyor 10 includes a substantially channel-shaped upper element 11 suspended from an underlying fixed support structure 13 by a plurality of oscillatable rockers 12 (see FIGS. 1 and 4 in particular).

Preferably, the ends of the conveyor 10 project from the tunnel structure 2, as can be appreciated from FIGS. 1 and 3 in particular.

In use, a flow of expanded shredded tobacco, for example, shredded sheets or leaves, or rolls of shredded, expanded tobacco, with a high moisture content, for example, 34% to 54%, is supplied to the input end of the conveyor 10.

This shredded tobacco may come from a previous (known) machine for the expansion of the shredded tobacco, such as that generally indicated 14 in FIGS. 1 and 3 ("steaming tunnel"), or from a Venturi tube expansion machine, or from other known machines.

The conveyor 10 thus transfers a layered flow of shredded tobacco T from the input end 6 to the output end 7 of the tunnel structure 2 of the dryer.

Figure 5:
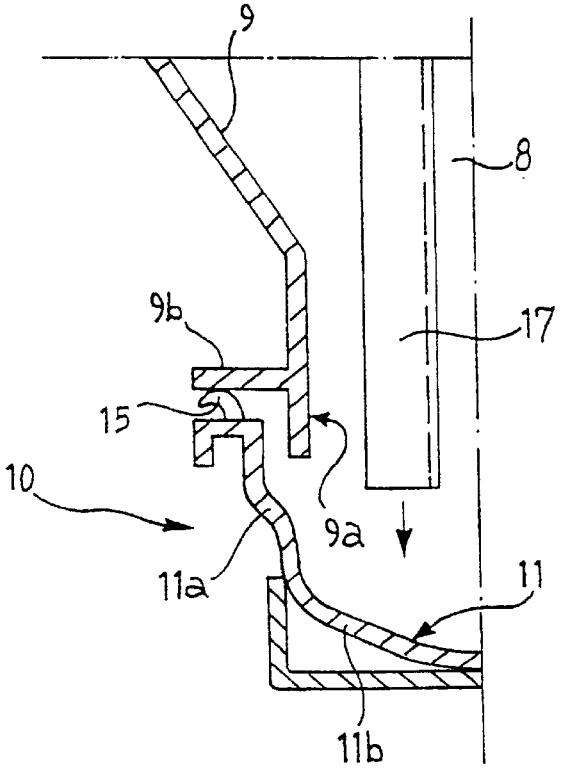
FIG. 5 is a view on an enlarged scale of a detail of FIG. 4.

Preferably, as is shown in FIGS. 4 and 5, the inclined converging side walls 9 of the chamber 8 have respective lower edge portions 9*a* which are substantially L-shaped in section, with an essentially horizontal outer limb or flange 9*b*.

Similarly, the channel element 11 of the conveyor 10 forms two lateral wall portions 11*a*, the upper edges of which face each other and are slightly spaced from the flanges 9*b* of the aforesaid walls. Advantageously, to form a seal, the edges of the wall portions 11*a* of the channel element 11 are provided with associated sealing lips, indicated 15 in FIG. 5, which co-operate with the flanges 9*b* of the aforesaid inclined walls 9 (FIG. 5).

As an alternative to the embodiment illustrated in the drawings, the conveyor 10 could be a non-oscillating belt conveyor, inclined slightly downwardly with respect to its horizontal plane, towards the output end of the tunnel structure 2. As a further alternative, the conveyor 10 could also be a slightly inclined belt conveyor which vibrates or advances stepwise in the tunnel structure.

The dryer includes a ventilation system which will now be described with particular reference to FIGS. 1 to 3.

Delivery manifold tubing, indicated 16 in FIGS. 1 and 2, extends longitudinally within the chamber 8 formed in the upper part of the tunnel structure 2, at a certain distance from the top 3.

In the embodiment illustrated by way of example, this tubing has a rectangular cross-section, and its lower wall 16*a* has a two-dimensional array of apertures to which are connected the ends of vertical tubes 17 which extend vertically downward to a certain distance from the channel element 11 of the conveyor 10.

The array of vertical tubes 17 extends, in particular, within the central region of the chamber 8, between the lower edges 9*a* of the plates or inclined walls 9, as shown in FIGS. 2 and 4 in particular.

Return manifold tubing indicated 18 in FIGS. 1 and 2 extends longitudinally above the delivery manifold tubing 16 in the upper portion of the chamber 8.

The upper wall 18*a* of the return manifold tubing 18 is spaced from the upper wall 3 of the tunnel structure 2, and has a plurality of apertures 19 (see FIG. 1 in particular).

Two identical units for the conditioning and recycling of the air are provided below the conveyor 10, symmetrically about the median transverse axis of the tunnel structure 2. Each unit includes a motor-driven fan 20 with an inlet tube 21 and an outlet tube 22.

The inlet tube 21 of each fan 20 communicates with an aperture 23 formed in a side wall of the return manifold tube 18 (FIG. 1). In particular, with reference to FIGS. 1 to 3, starting at the aperture 23, the inlet tube 21 curves downwards (FIG. 2), then descends first of all vertically and then at an angle to the vertical (FIGS. 1 and 3) and finally, below the conveyor 10, curves and reaches the inlet of the fan 20 in a substantially horizontal path.

The outlet tube 22 of each fan 20 leads to an air-conditioning complex 24 in which the air delivered by the fan is reheated, for example, by a steam/air heat exchanger, and may be dehumidified.

Downstream of the complex 24, the conditioned air is divided into two flows which enter two pipes 25 which extend horizontally initially below the conveyor 10 (FIGS. 2 and 3), and then curve vertically upward until they reach the level of the delivery manifold tubing 16, to which they are connected by curved connector parts 25*a* (FIG. 2).

In use, the activation of a fan 20 causes a flow of air in the directions of the arrows in the drawings: the air passes through the outlet tube 22, then through the conditioning complex 24 and the pipes 25 to the delivery manifold tube 16, and through the apertures formed in the lower wall 16*a* of the latter to enter the vertical tubes 17. The air leaves the lower ends of these vertical tubes 17 as jets close to the channel element 11 of the conveyor 10, thereby creating a fluid bed above this channel element which fluidizes the layered flow of tobacco T which gradually advances on the conveyor 10 from the input end 6 to the output end 7 of the tunnel structure 2.

The tobacco particles are effectively surrounded by the air leaving the array of vertical tubes 17, which air dries them. The tobacco is therefore progressively and slowly dried as it passes through the tunnel structure 2, and its volume also increases significantly.

Each fan 20 also causes the air emitted from the tubes 17 to return to the return manifold tubing 18. In particular, as illustrated in FIG. 2, after interacting with the layered flow of tobacco, the air is returned through the lateral portions or regions of the chamber 8 situated at the sides of the array of tubes 17, and therefore rises towards the top of the chamber 8, passing over the inclined walls 9. The returning air therefore passes through arcuate filtration grids 30 (FIGS. 2 and 6) which, in the embodiment illustrated, extend along the entire tunnel structure between the delivery manifold tube 16 and the upper wall 3 of the tunnel structure itself.

Having passed through the filtration grids 30, the return air is collected into the return manifold tube 18 through the upper apertures 19 in this latter, and hence is returned to the inlet tube 21 which leads to the fans 20.

At the output end 7 of the tunnel structure 2, the usual moisture content of the tobacco is of the order of 12–13%.

In the embodiment illustrated in the drawings (FIGS. 1 and 3), a further conveyor 31 is provided below the output end of the conveyor 10 and receives the dried tobacco which falls onto it and transfers it to other destinations or work stations.

In use, any tobacco particles conveyed upwards by the return air can fall under gravity onto the converging inclined side walls 9 of the chamber 8 and are again conveyed into the channel element 11 of the conveyor 10.

In order to avoid shredded tobacco accumulating on the side wall portions of the channel element 11, the base wall of this channel element advantageously has, against each portion, an inclined wall portion, indicated lib in FIG. 5, which tends to make tobacco on it "slide" towards the central region of the channel element 11 so as to make the height of the layered flow of tobacco conveyed towards the output of the tunnel structure substantially uniform.

Figure 6:
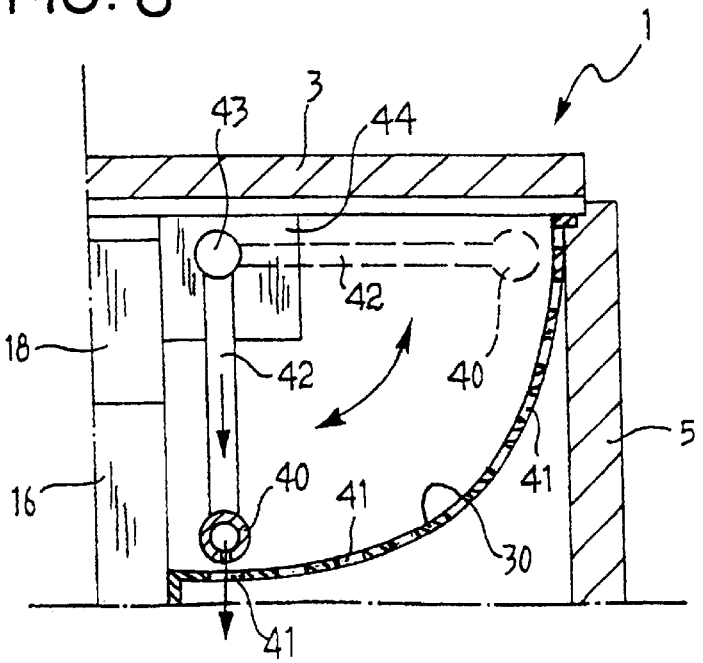
FIG. 6 is a partially sectioned view which shows a cleaning device associated with a filtration grid included in the machine according to the invention.

As shown in FIG. 6, a pneumatic cleaning device may, to advantage, (but not necessarily) be associated with each of the filtration grids 30 for preventing it being clogged by any particles carried in the air.

Figure 7:
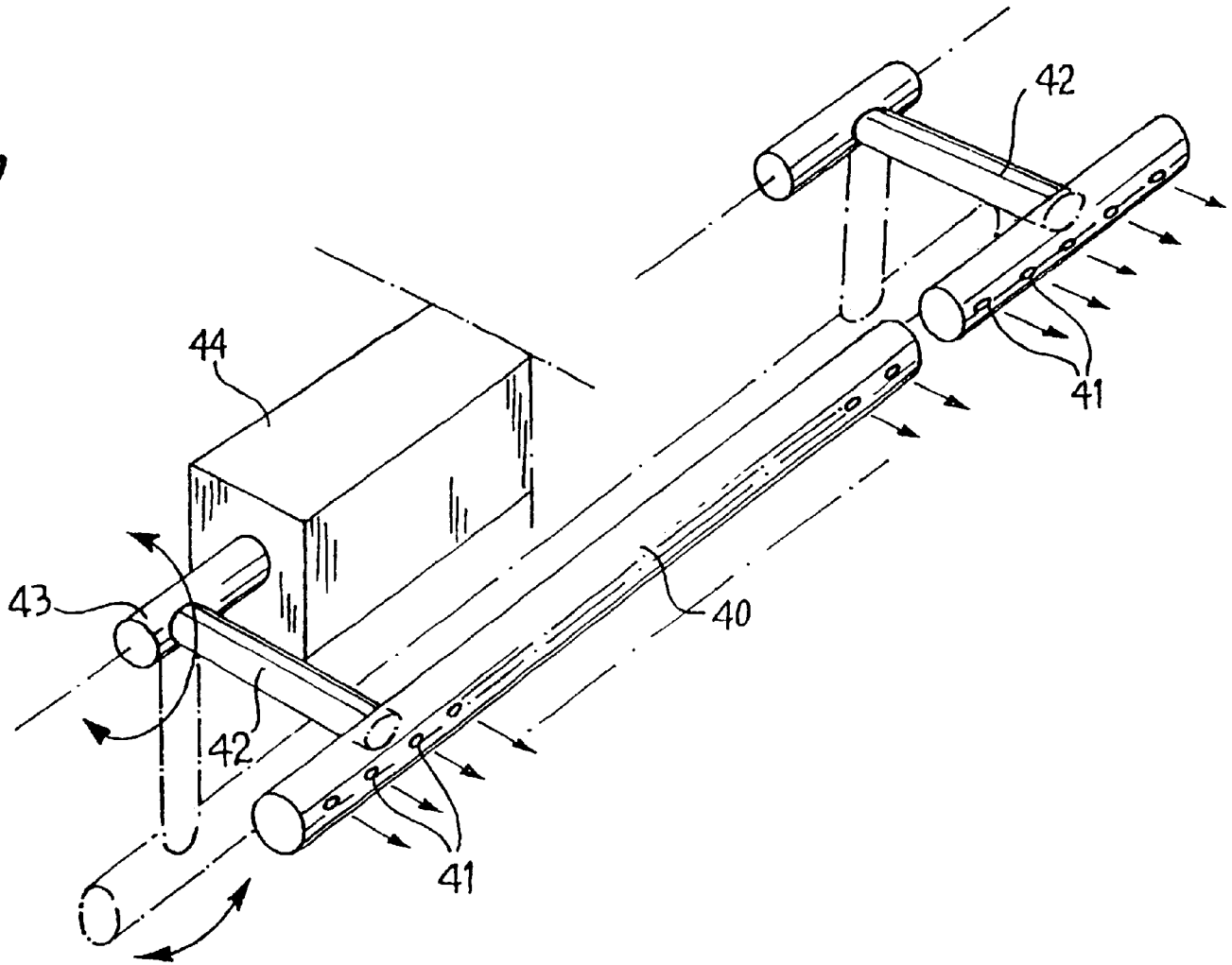
FIG. 7 is a partial perspective view of the cleaning device of FIG. 6.

An embodiment of such a cleaning device will now be described with reference to FIGS. 6 and 7.

The pneumatic cleaning device illustrated includes a longitudinally extending duct 40 having a plurality of blower apertures 41 facing the grid 30.

The duct 40 communicates by means of two or more radial connector tubes 42 with a supply tube 43 which receives a flow of pressurised air from a source of a type which is in itself known and not illustrated.

The duct 40 can be made to oscillate periodically by means of a motion device 44 of known type, so that the jets of pressurised air leaving its apertures 41 impinge upon the associated grid, thus cleaning it.

The dryer according to the invention has many advantages.

In the first place, it is extremely compact due to the disposition of the ventilation system within the tunnel structure 2, with the delivery tubes 25 and return tubes 21 at the sides of the array of tubes 17 and the air conditioning and recycling units disposed below the conveyor 10.

Secondly, the shape of the working chamber 8, and in particular its converging inclined walls 9, enables any tobacco particles carried away from the conveyor 10 by the return air to be recovered easily and advantageously. By virtue of this characteristic the dryer does not need traditional cyclone systems for the collection and filtration of the dust for reliable operation, with clear advantages from the point of view of cost and the overall size of the machine.

In the machine described above with reference to the drawings, the ventilation system includes two identical air conditioning and recycling units, symmetrically arranged and associated respectively with the two longitudinal portions of the tunnel structure 2. This arrangement is particularly advantageous in that it enables the intensity of the dehumidification effected in the first and second portions of the tunnel structure to be controlled differentially. Dehumidification may be made more intense in the initial portion and relatively less intense in the final portion.

This may easily be effected through the control of the temperature and flow rate of the air flowing through the two conditioning and recycling units.

The invention is not to be understood in any way as being limited to a machine necessarily having two such air conditioning and recycling units, but extends equally to machines having only one or more than two such units.

The side walls 4 and 5, as well as the upper wall 3 of the tunnel structure 2, may be formed with removable, possibly hinged, panels, to facilitate easy inspection or access for maintenance and/or cleaning.

Naturally, the principle of the invention remaining the same, the embodiments and the details of manufacture may be widely varied with respect to that described and illustrated by way of non-limitative example, without by this departing from the ambit of the invention as defined in the following claims.

What is claimed is:

1. A machine (1) for drying shredded tobacco (T), including:

a tunnel structure (2) with an input end (6) and an output end (7) in which a chamber (8) with inclined longitudinal, downwardly-converging side walls (9) is defined;

a substantially horizontal conveyor (10) which extends within the tunnel structure (2) adjacent the lower edges **(9*b*) of the converging side walls (9), for transferring a layered flow of shredded tobacco (T) from the inlet (6) to the outlet (7); and a ventilation system (16–25)** including:

a delivery manifold (16) which extends over the conveyor (10);

an array of essentially vertical tubes (17) which extends from the delivery manifold (16) to a predetermined distance from the conveyor (10), between the lower edges **(9*a*) of the converging side walls (9)**;

a return manifold (18) communicating with lateral regions of the chamber (8) situated at the sides of the array of tubes (17) and above the converging side walls (9); and air conditioning and recycling means (20–25) interposed between the outlet (23) of the return manifold (18) and the delivery manifold (16), and adapted to supply a flow of conditioned air through the tubes (17) towards the conveyor (10) in such a way that, in use, the air leaving the tubes (17) creates a bed of air above the conveyor (10) for fluidizing the layered flow of tobacco (T), and the air emitted from the tubes (17) is then returned to the return manifold (18) through the lateral regions of the chamber (8) in such a way that any tobacco particles carried by the return air flow in the lateral regions of the chamber (8) fall under gravity onto the converging side walls (9) and down on to the conveyor (10).

2. A machine according to claim 1, characterised in that the conveyor (10) includes a channel-shaped element (11) the side walls **(11*a*) of which are connected with a substantially air-tight seal to the lower edges (9*a*, 9*b*) of the inclined side walls (9) of the chamber (8)**.

3. A machine according to claim 2, characterised in that the channel-shaped element (11) of the conveyor (10) is inclined slightly downwardly towards the output end of the tunnel structure (2), and is mounted so as to be oscillatable on a fixed support structure (13).

4. A machine according to claim 1, characterised in that the delivery manifold (16) and the return manifold (18) extend longitudinally above the upper portion of the chamber (8).

5. A machine according to claim 1, characterised in that the air conditioning and recycling means (20–25) include a motor-driven fan (20) and a complex (24) for treating the air, disposed below the conveyor (10).

6. A machine according to claim 1, characterised that filtration grids (30) for retaining or repelling any particles of tobacco carried by the return air are disposed in the chamber (8) above the inclined side walls (9).

7. A machine according to claim 6, characterised in that pneumatic cleaning devices (40–44) are associated with the filtration grids (30).

8. A machine according to claim 7, characterised in that the filtration grids (30) are substantially in the form of circular arcs in section, and the associated cleaning devices (40–44) include an oscillating tube (40) provided with a series of apertures (41) for emitting jets of air towards the filtration grids (30).

9. A machine according to claim 1, characterised in that the ventilation system includes a plurality of air conditioning and recycling units (20, 24), each of which is associated with a respective longitudinal portion of the tunnel structure (2) and the chamber (8) defined therein.

10. A machine according to claim 9, characterised in that each of the air conditioning and recycling units (20, 24) is able to control the characteristics of the air treated therein differentially.

* * * * *